US010272666B2

(12) United States Patent
Swisher et al.

(10) Patent No.: US 10,272,666 B2
(45) Date of Patent: Apr. 30, 2019

(54) DEVICE, METHOD, AND KIT FOR APPLYING STENCIL PATTERNS TO A FABRIC AND FABRIC-LIKE MATERIAL

(71) Applicant: INNOVATIVE ART CONCEPTS, LLC, Ramsey, NJ (US)

(72) Inventors: John G. Swisher, Mahwah, NJ (US); Janna Makaeva, Mahwah, NJ (US); Aleksandr Aliskerov, Mahwah, NJ (US)

(73) Assignee: INNOVATIVE ART CONCEPTS, LLC, Ramsey, NJ (US)

( * ) Notice: Subject to any disclaimer, the term of this patent is extended or adjusted under 35 U.S.C. 154(b) by 0 days.

(21) Appl. No.: 15/317,967

(22) PCT Filed: Jun. 15, 2015

(86) PCT No.: PCT/US2015/035824

§ 371 (c)(1),
(2) Date: Dec. 11, 2016

(87) PCT Pub. No.: WO2015/192128

PCT Pub. Date: Dec. 17, 2015

(65) Prior Publication Data

US 2017/0113451 A1 Apr. 27, 2017

Related U.S. Application Data

(60) Provisional application No. 62/011,892, filed on Jun. 13, 2014.

(51) Int. Cl.
*B41F 15/02* (2006.01)
*B41N 1/24* (2006.01)
(Continued)

(52) U.S. Cl.
CPC ..... *B41F 15/02* (2013.01); *A41H 3/01* (2013.01); *B05C 17/08* (2013.01); *B41L 13/02* (2013.01); *B41N 1/24* (2013.01); *B44D 2/007* (2013.01)

(58) Field of Classification Search
CPC .. B41F 15/00; B41F 15/0813; B41F 15/0845; B41F 15/085; B41F 15/26; B41F 15/34; B41F 15/36; B41F 15/42; B41F 17/003; B41F 17/38; B41F 15/02; B41L 13/02; B41M 1/12; B05C 17/06; B05C 17/08; B41N 1/24; B44D 2/007; A41H 3/01
See application file for complete search history.

(56) References Cited

U.S. PATENT DOCUMENTS 4,023,524 A * 5/1977 Goldfarb ..... A63H 33/22 101/114
4,750,421 A * 6/1988 Lucas ..... B41F 15/36 101/128

(Continued)

OTHER PUBLICATIONS

International Search Report and Written Opinion, issued in PCT/US2015/035824, dated Sep. 14, 2015.

*Primary Examiner* — Leslie J Evanisko
*Assistant Examiner* — Marissa Ferguson-Samreth
(74) *Attorney, Agent, or Firm* — FisherBroyles, LLP; Andrew K. Gonsalves, Esq.

(57) ABSTRACT

The present invention relates to devices, methods, and kits for applying stencil patterns to surfaces, particularly to surfaces made of fabric or fabric-like materials.

19 Claims, 26 Drawing Sheets

Figure 1:
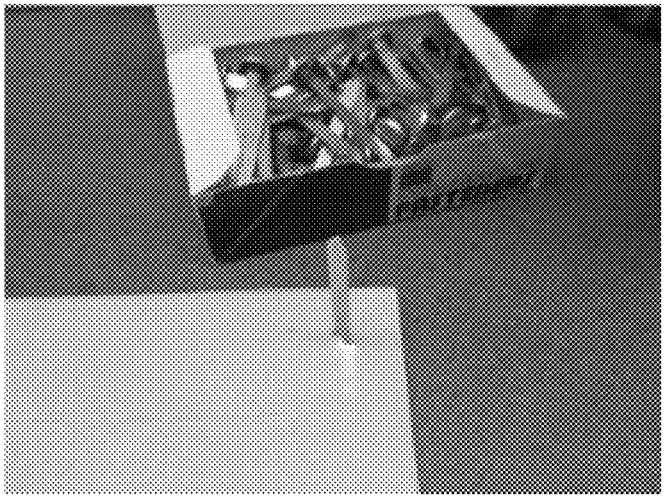
Figure 2:
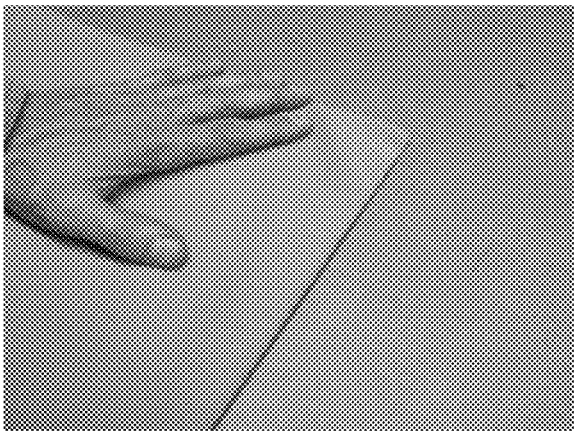
Figure 3:
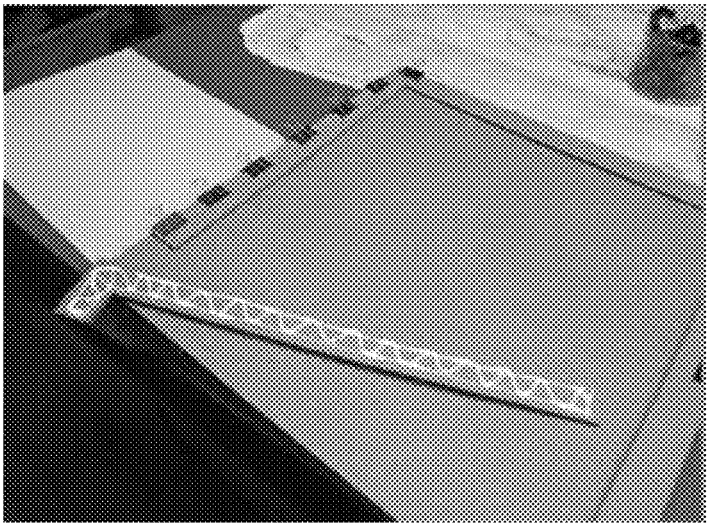
Figure 4:
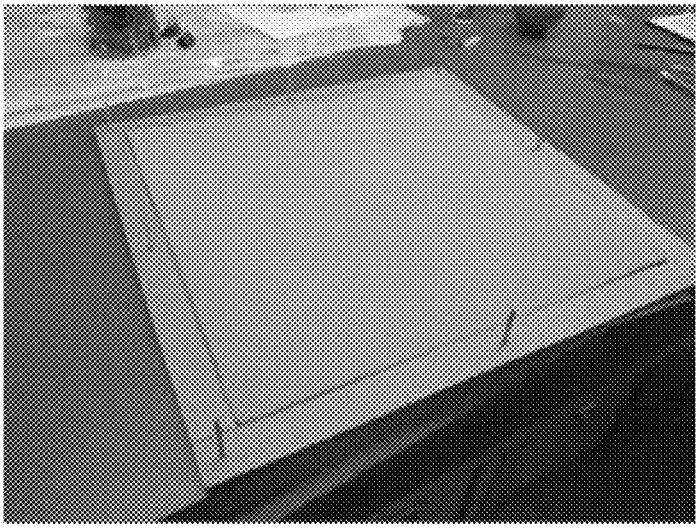

(51) Int. Cl.

| | |
|---|---|
| ***B41L 13/02*** | (2006.01) |
| ***B05C 17/08*** | (2006.01) |
| ***A41H 3/01*** | (2006.01) |
| ***B44D 2/00*** | (2006.01) |

(56) References Cited

U.S. PATENT DOCUMENTS 4,852,483 A * 8/1989 Bussard ..... B41F 15/02 101/114
4,938,130 A 7/1990 Thorpe
4,981,075 A 1/1991 Christman
5,718,331 A * 2/1998 Smith ..... B65D 85/182 206/278
6,698,349 B2 * 3/2004 Komata ..... B41F 15/36 101/127
6,776,091 B2 * 8/2004 Goss ..... B41F 15/36 101/127.1
7,056,017 B2 * 6/2006 Daniel ..... H05G 1/02 378/141
8,590,448 B2 * 11/2013 Swisher ..... B05C 1/027 101/115
2005/0229421 A1 * 10/2005 Deas ..... B41C 1/148 33/563
2008/0282914 A1 * 11/2008 Black ..... B41C 1/14 101/127
2009/0282992 A1 * 11/2009 Mulrooney ..... A63F 9/06 101/127.1
2010/0064913 A1 * 3/2010 Sego ..... B41F 15/04 101/126
2010/0300312 A1 12/2010 Niswonger
2012/0234482 A1 * 9/2012 Ihm ..... B44D 2/007 156/249
2013/0284036 A1 * 10/2013 Wade ..... B41L 13/02 101/123
2014/0109515 A1 * 4/2014 Cigana ..... A47F 5/10 53/397
2017/0000205 A1 * 1/2017 Schow ..... A41H 5/00
2017/0157915 A1 * 6/2017 Roth ..... B44D 2/002

* cited by examiner

DEVICE, METHOD, AND KIT FOR APPLYING STENCIL PATTERNS TO A FABRIC AND FABRIC-LIKE MATERIAL

CROSS-REFERENCE TO RELATED APPLICATIONS

This application is a U.S. National Phase filing under 35 U.S.C. § 371 of International Application No. PCT/US2015/035824, filed Jun. 15, 2015, and published as WO 2015/192128 A1 on Dec. 17, 2015, which claims priority benefit of U.S. Provisional Patent Application Ser. No. 62/011,892, filed Jun. 13, 2014, the disclosures of which are hereby incorporated by reference herein in their entirety.

FIELD OF THE INVENTION

The present invention relates to devices, methods, and kits for applying stencil patterns to surfaces, particularly to surfaces made of fabric or fabric-like materials.

BACKGROUND OF THE INVENTION

Patterns are incorporated onto the surfaces of fabrics and fabric-like materials using various techniques. Some of these fabrics are used for items such as pillowcases, tote bags, shirts, flags, and the like. It is well known in the art that it is often cumbersome, inefficient, and difficult to apply stenciled patterns to fabrics and fabric-like materials on a consistent basis. With fabrics and fabric-like materials, one is dealing with uneven surfaces, which makes the process of applying patterns to these surfaces using stencils is difficult and creates imperfect results. Further, with such processes the fabric can move around, which can require one to tape both the fabric (e.g., pillowcase) and stencil to a working surface. When applying a pattern to a pillowcase, there is often no extra room to place tape around it without taping off some of the pillowcase. Additionally, most stencils are not specifically designed for fabric and fabric-like materials such as those used as pillowcases, which means that one must repeat the design over and over to stencil these surfaces. While one can certainly stencil such fabrics or fabric-like materials without a frame, there are certain disadvantages with such an approach.

The present invention is directed to overcoming these and other deficiencies in the art.

SUMMARY OF THE INVENTION

The present invention relates to devices, methods, and kits for applying stencil patterns to surfaces, particularly to surfaces made of fabric or fabric-like materials.

In one aspect, the present invention relates to a device for applying stencil patterns to a surface, including, without limitation, to a surface that is a fabric or fabric-like material.

In one embodiment, the device comprises: a frame for positioning the fabric or fabric-like material at a desired position; and at least one set of fasteners integrated at opposing positions on the frame, wherein the fasteners are used for positioning and securing a stencil at a desired position over the fabric or fabric-like material.

In another embodiment, the device further comprises a baseboard attached to the frame for holding the fabric or fabric-like material at a desired depth below frame.

In yet another embodiment, the device further comprises a frame insert comprising a planar surface having dimensions that fit inside the frame, wherein the frame insert is used for maintaining the surface of the fabric or fabric-like material in a substantially flattened position within the frame and under the stencil.

In another aspect, the present invention relates to a method for applying a stencil pattern to a surface, including, without limitation, to a surface that is a fabric or fabric-like material. In one embodiment, the method comprises: providing a device for applying a stencil pattern to a surface of a fabric or fabric-like material as contemplated and disclosed herein; using the device to secure a stencil over a fabric or fabric-like material at a desired position, wherein the stencil comprises a pattern to be transferred to the fabric or fabric-like material; and painting over the stencil in order to apply the stencil pattern to the fabric or fabric-like material.

In one embodiment, the method further comprises providing at least one stencil configured for use with the frame fasteners of the device.

In another aspect, the present invention relates to a kit for applying a stencil pattern or multiple stencil patterns to a surface, including, without limitation, to a surface that is a fabric or fabric-like material. In one embodiment, the kit comprises: a device for applying a stencil pattern to a surface of a fabric or fabric-like material as contemplated and disclosed herein; and at least one stencil configured for use with the device.

DETAILED DESCRIPTION OF THE INVENTION

The present invention relates to devices, methods, and kits for applying stencil patterns to a surface or surfaces. As used herein, the term "surface" is meant to include any material that can be used for applying a stencil pattern thereto using a device of the present invention. In various embodiments, the surface can include, without limitation, any surface made of fabric or fabric-like materials. Examples of a fabric or fabric-like material can include, without limitation, a pillowcase, a tote bag, a shirt, a flag, a banner, a jacket, a garment, a bag, a backpack, a tent, a cap, a scarf, a bandana, and the like. While various aspects and embodiments of the devices, methods, and kits of the present invention may be described as being used for a fabric or fabric-like material, the present disclosure is not meant to be limited to surfaces made of fabric or fabric-like materials, but rather can be used for any surface that can be used for applying a stencil pattern thereto using a device of the present invention.

In one aspect, the present invention relates to a device for applying stencil patterns to surfaces, including, without limitation, to surfaces made of fabric or fabric-like materials. In one embodiment, the device comprises: a frame for positioning the fabric or fabric-like material at a desired position; and at least one set of fasteners integrated at opposing positions on the frame, wherein the fasteners are used for positioning and securing a stencil at a desired position over the fabric or fabric-like material. In various embodiments, the frame can hold the fabric or fabric-like material in place without the use of an adhesive (e.g., without tape). In various embodiments, the frame can be of any geometric shape (e.g., square, rectangle, star, circle, oval, triangle, etc.) suitable for use with a particular stencil.

In one embodiment, the at least one set of fasteners is positioned at opposing corners of the frame and/or on opposing sides of the frame. In other embodiments, the at least one set of fasteners is positioned on the frame to enable securing the stencil so that the stencil pattern can be applied to the desired surface in a vertical, horizontal, and/or diagonal orientation in reference to the surface to be stenciled.

In another embodiment, the device further comprises a baseboard attached to the frame for holding the fabric or fabric-like material at a desired depth below frame.

In yet another embodiment, the device further comprises a frame insert comprising a planar surface having dimensions that fit inside the frame, wherein the frame insert is used for maintaining the surface of the fabric or fabric-like material in a substantially flattened position within the frame and under the stencil. The frame insert can be made of any material that can be used for the intended purpose as described herein. In one embodiment, the frame insert can be made of cardboard and more specifically as corrugated cardboard. In a particular embodiment, the frame insert can be foldable to facilitate insertion of the frame insert into such materials as pillowcases or cushions (e.g., materials may only have a single side that opens and that are meant to be stuffed and closed using a closing mechanism such as a zipper on that single opening side).

In certain embodiments, a stencil can be used with only a single fastener (e.g., like a feather stencil that is secured with only one of the fasteners on the frame at a time). Such a stencil can be used separately on one or more of the fasteners of the frame at a time.

In another aspect, the present invention relates to a method for applying a stencil pattern to a surface, including, without limitation, to a surface that is a fabric or fabric-like material. In one embodiment, the method comprises: providing a device for applying a stencil pattern to a surface of a fabric or fabric-like material as contemplated and disclosed herein; using the device to secure a stencil over a fabric or fabric-like material at a desired position, wherein the stencil comprises a pattern to be transferred to the fabric or fabric-like material; and painting over the stencil in order to apply the stencil pattern to the fabric or fabric-like material.

In one embodiment of the method of the present invention, the device comprises: a frame for positioning the fabric or fabric-like material at a desired position; and at least one set of fasteners integrated at opposing positions on the frame, wherein the fasteners are used for positioning and securing a stencil at a desired position over the fabric or fabric-like material. In various embodiments, the at least one set of fasteners is positioned at opposing corners of the frame and/or on opposing sides of the frame. In various embodiments, the at least one set of fasteners is positioned on the frame to enable securing the stencil so that the stencil pattern can be applied to the desired surface in a vertical, horizontal, and/or diagonal orientation in reference to the surface to be stenciled.

In another embodiment, the method further comprises providing a baseboard attached to the frame for holding the fabric or fabric-like material at a desired depth below frame.

In another embodiment, the method further comprises providing a frame insert comprising a planar surface having dimensions that fit inside the frame, wherein the frame insert is used for maintaining the surface of the fabric or fabric-like material in a substantially flattened position within the frame and under the stencil.

In another embodiment, the method further comprises providing at least one stencil configured for use with the frame fasteners of the device. In various embodiments, the at least one stencil comprises a border region configured to fit over the frame of the device. In various embodiments, the border region of the at least one stencil includes cut-out regions for interfacing with the frame fasteners of the frame. In various embodiments, the cut-out regions are configured for fixed positioning or variable positioning of the stencil in reference to a particular pair of frame fasteners. In various embodiments, the variable positioning of the cut-out regions of the stencil are effective to produce a shadow effect of the stencil pattern on the fabric or fabric-like material. In various embodiments, the fabric or fabric-like material is selected from the group consisting of a pillowcase, a tote bag, a shirt, a flag, a banner, a jacket, a garment, a bag, a backpack, a tent, a cap, a scarf, a bandana, and the like.

In certain embodiments of the method, a stencil can be used with only a single fastener (e.g., like a feather stencil that is secured with only one of the fasteners on the frame at a time). Such a stencil can be used separately on one or more of the fasteners of the frame at a time.

In another aspect, the present invention relates to a kit for applying a stencil pattern or multiple stencil patterns to a surface, including, without limitation, to a surface that is a fabric or fabric-like material. In one embodiment, the kit comprises: a device for applying a stencil pattern to a surface, including, without limitation, to a surface that is a fabric or fabric-like material, as contemplated and disclosed herein; and at least one stencil configured for use with the device.

In one embodiment of the kit of the present invention, the device comprises: a frame for positioning the fabric or fabric-like material at a desired position; and at least one set of fasteners integrated at opposing positions on the frame, wherein the fasteners are used for positioning and securing a stencil at a desired position over the fabric or fabric-like material. In various embodiments, the at least one set of fasteners is positioned at opposing corners of the frame and/or on opposing sides of the frame. In various embodiments, the at least one set of fasteners is positioned on the frame to enable securing the stencil so that the stencil pattern can be applied to the desired surface in a vertical, horizontal, and/or diagonal orientation in reference to the surface to be stenciled.

In one embodiment of the kit of the present invention, the device further comprises a baseboard attached to the frame for holding the fabric or fabric-like material at a desired depth below frame.

In one embodiment of the kit of the present invention, the kit further comprises a frame insert comprising a planar surface having dimensions that fit inside the frame, wherein the frame insert is used for maintaining the surface of the fabric or fabric-like material in a substantially flattened position within the frame and under the stencil.

In one embodiment of the kit of the present invention, the at least one stencil comprises a border region configured to fit over the frame of the device. In various embodiments, the border region of the at least one stencil includes cut-out regions for interfacing with the frame fasteners of the frame. In various embodiments, the cut-out regions are configured for fixed positioning or variable positioning of the stencil in reference to a particular pair of frame fasteners. In various embodiments, the variable positioning of the cut-out regions of the stencil are effective to produce a shadow effect of the stencil pattern on the fabric or fabric-like material.

In various embodiments, the kit can include a fabric or fabric-like material that is suitable for being stenciled using the device of the present invention, including, without limitation, fabric or fabric-like materials such as a pillowcase, a tote bag, a shirt, a flag, a banner, a jacket, a garment, a bag, a backpack, a tent, a cap, a scarf, a bandana, and the like.

In various embodiments, the kit of the present invention can include a portion of, substantially all of, or all of the materials needed to produce a stenciled surface using the device as contemplated or disclosed herein. For example, the kit can include a portion of, substantially all of, or all of the following items: stenciling instructions (e.g., written, video, audio, etc.), stencil paints, paint brushes, markers, stencils, fabrics, fabric-like materials, paint mixing materials, paint storing and holding materials, paint cleaning materials, a device or devices of the present invention (including parts or components and extra parts or components of the device), adornments to be added to the stenciled surface (e.g., tassels, studs, buttons, glitter, patches, swatches, etc.), pillows, cushions, stuffing materials (e.g., for pillows or beanbags), a storage box for the kit (including a portable box configuration, such as one that includes a handle for carrying the kit), measuring devices, plates (e.g., paper plates) for use in holding paint or mixing paint, attachments for hanging stenciled materials (e.g., for hanging stenciled banners, flags, etc. to a wall), and any other item need to make and use a stenciled material. Therefore, in certain embodiments, the kit comprises an all-inclusive collection of all materials needed to use the device of the present invention to make and use a stenciled material (e.g., a pillowcase with pillow, a banner, a cushion, etc.).

Overview of Various Embodiments of the Device

The present invention provides a device for stenciling patterns onto a fabric, including, without limitation, a fabric used as a pillowcase or cushion covering. In one embodiment, the device comprises a baseboard having a frame for fitting a flattened piece of fabric within the frame. The flattened piece of fabric can be a pillowcase, a cushion case, or any other desired fabric to be stenciled. Fasteners protrude from portions of the frame and are used to secure a stencil in place over the flattened piece of fabric. For pillowcases and cushion cases, an insert can be fitted inside the pillowcase or cushion case in order to prevent leaking of paint to the backside of the pillowcase or cushion case. In certain embodiments, the insert can be a material such as cardboard that is fitted to custom fit the pillowcase or cushion case, including to fit within the frame of the device.

The present invention also provides a kit that includes the device and some or all of the necessary components to stencil a fabric using the device. Such a kit can include, without limitation, paint, paint rollers, instructions, pillowcase inserts, stencils, fasteners, pieces of fabric to be stenciled, frames or frame components for building the frame, levels, rulers, etc.

The present invention also provides a method for using the aforementioned device for stenciling patterns onto a fabric such as a pillowcase or cushion covering. The method can involve, without limitation, using the device to apply paint or a similar transferable substance to the fabric in a desired pattern. The pattern can be of a single color or multicolor. In certain embodiments, the device can be used to make a wrap-around type of pattern on a two-sided fabric or fabric-like material such as a pillowcase or cushion covering.

In one embodiment, the present invention provides a device having a very neatly designed square stencil with slits for perfect alignment and fastening.

Exemplary Embodiment of the Use of a Device of the Present Invention

Provided below is one embodiment of a device of the present invention and the use of the device to stencil a pillowcase.

In this embodiment, fasteners are being used for securing purposes as shown in more detail below. However, the present invention also contemplates the use of a shorter fastener that does not have a sharp tip.

In one embodiment, an ironed pillowcase is used to prepare a cardboard insert that fits the shape of the pillowcase.

In one embodiment, a frame device is assembled for use as part of the device of the present invention. Basically, the frame device includes a frame and a baseboard made of cardboard (or foamboard) that accommodates the size of the pillow or cushion, e.g., 18×18 pillow or any other size pillow or cushion.

In one embodiment, a pillowcase that has a cardboard insert (to prevent paint leaking through) gets dropped into the frame. The thickness of the frame is such that everything gets nicely leveled for stenciling. Fasteners for keeping the stencil in place can be used with the frame. For example, one side of each fastener tab that extends from the frame can be bent around the frame to hold the stencil in place. In other embodiments, the fasteners are glued from underneath and placed at certain intervals.

Figure 5:
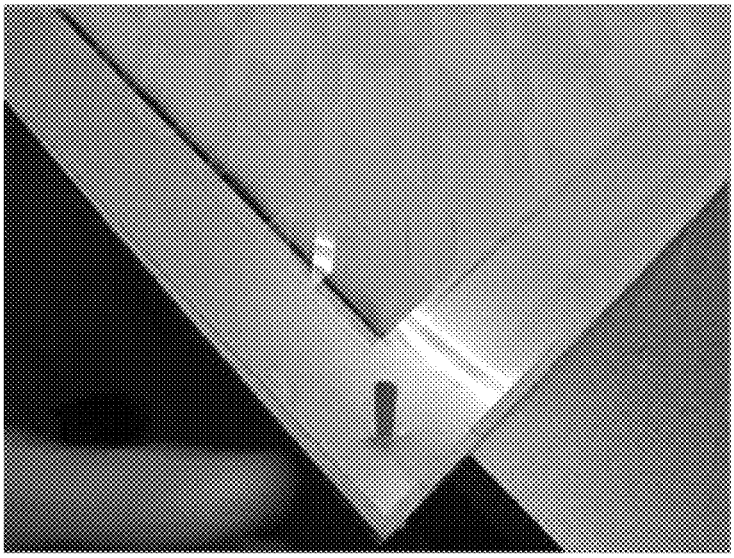
Figure 6:
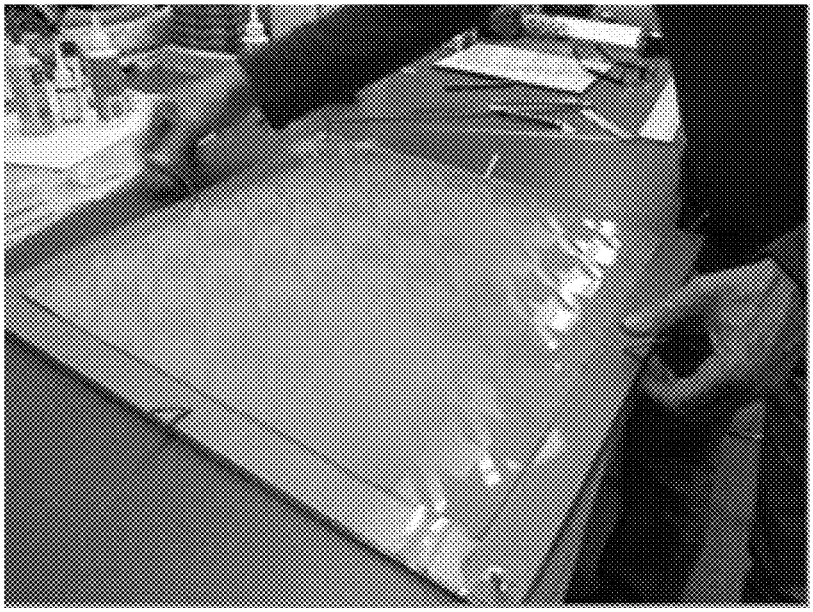
Figure 7:
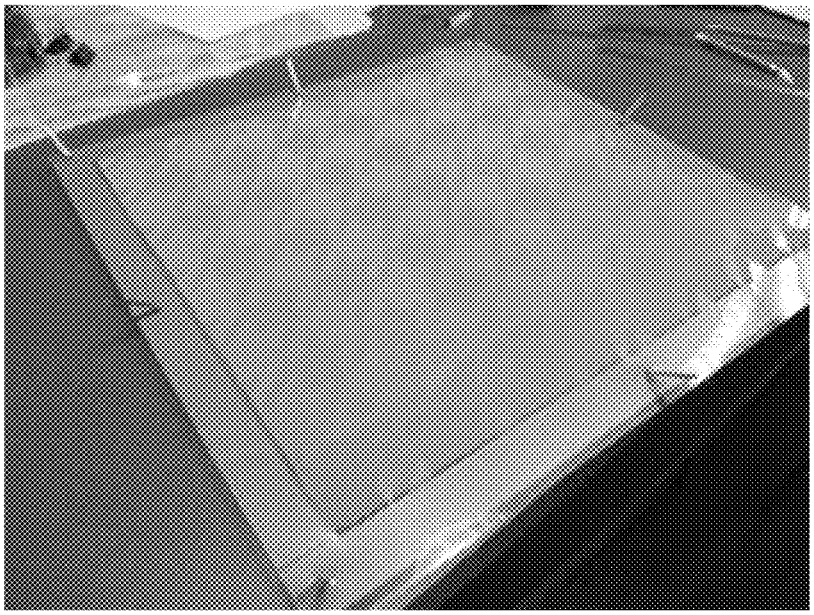
Figure 8:
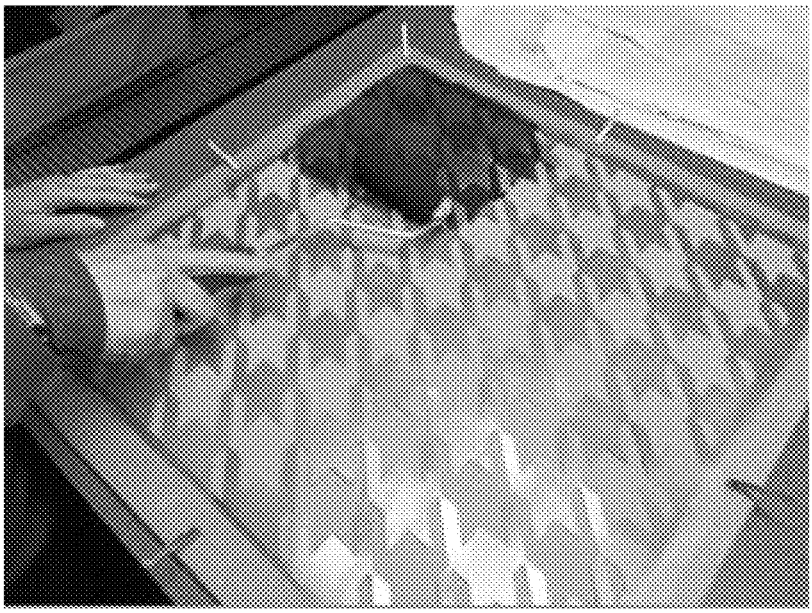
Figure 9:
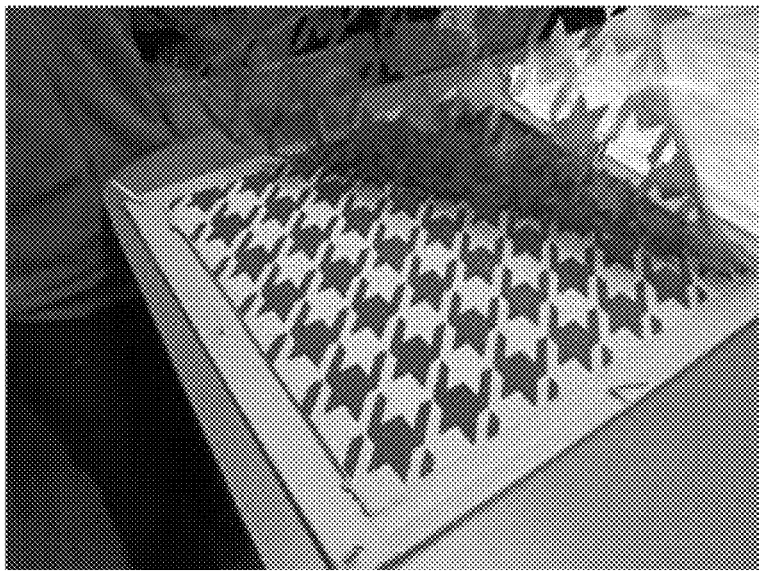
Figure 10:
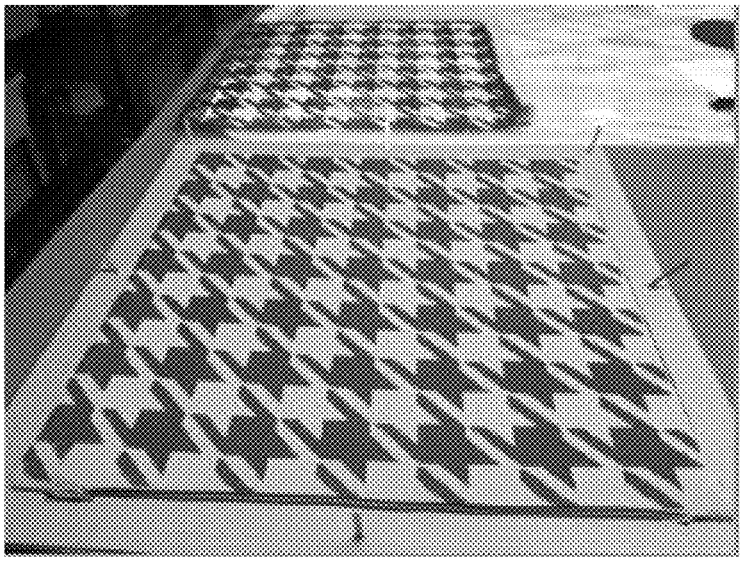
Figure 11:
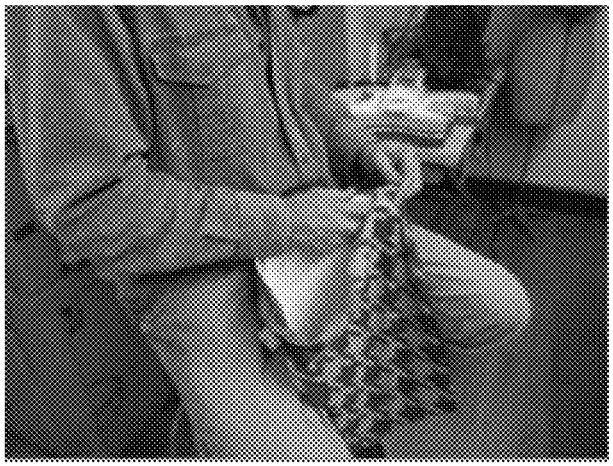
Figure 12:
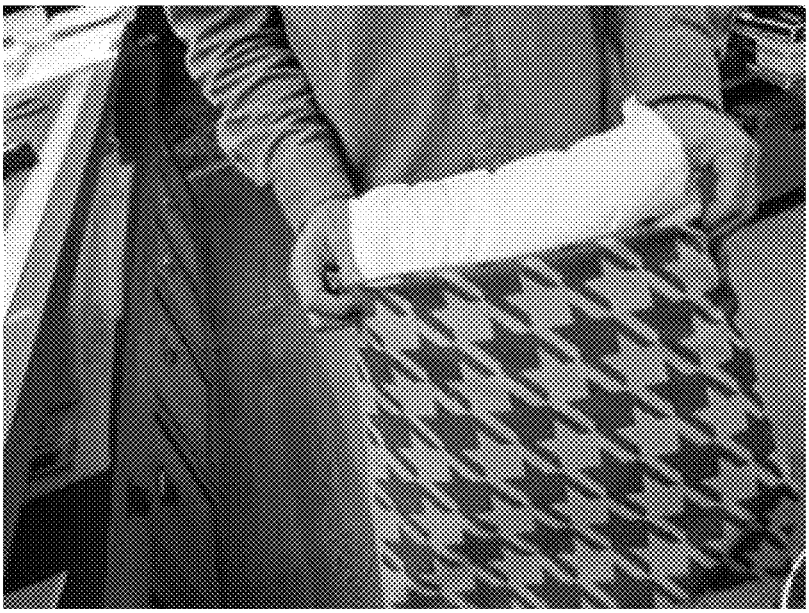
Figure 13:
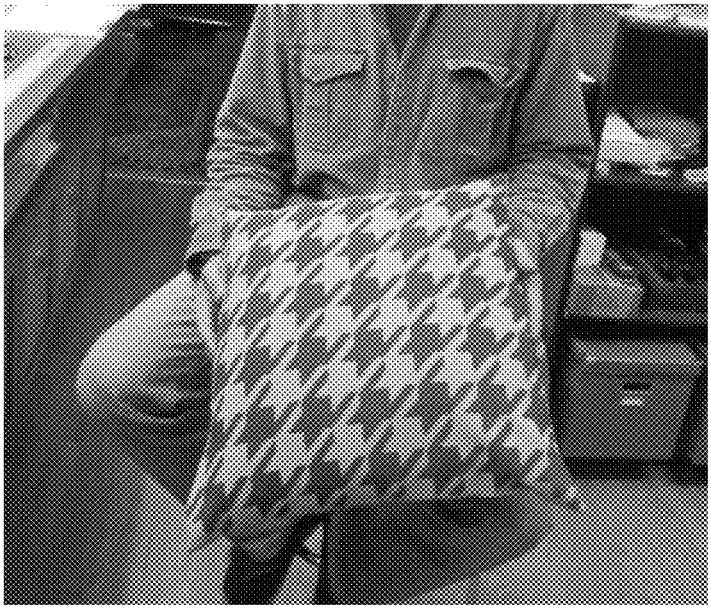
Figure 14:
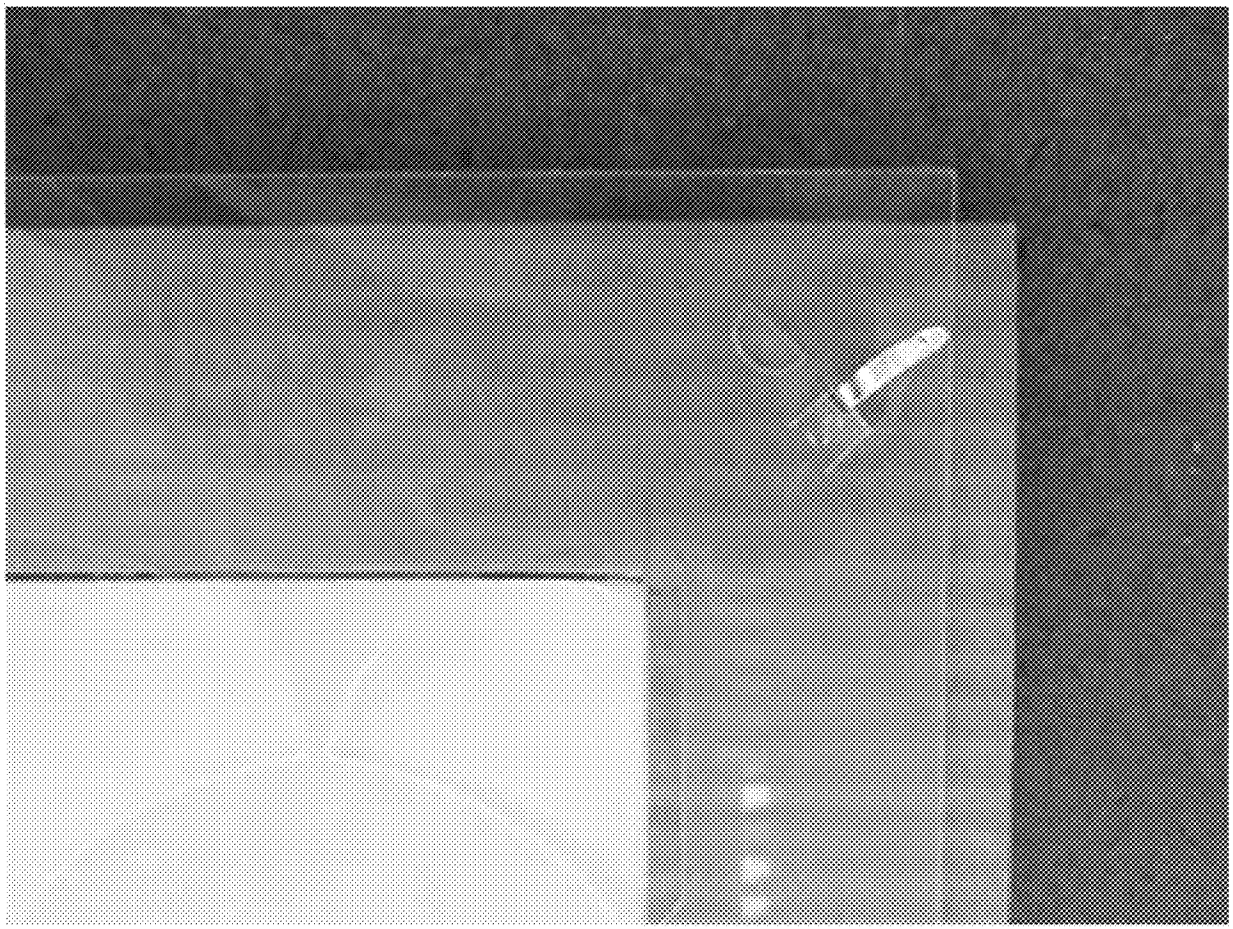
Figure 15:
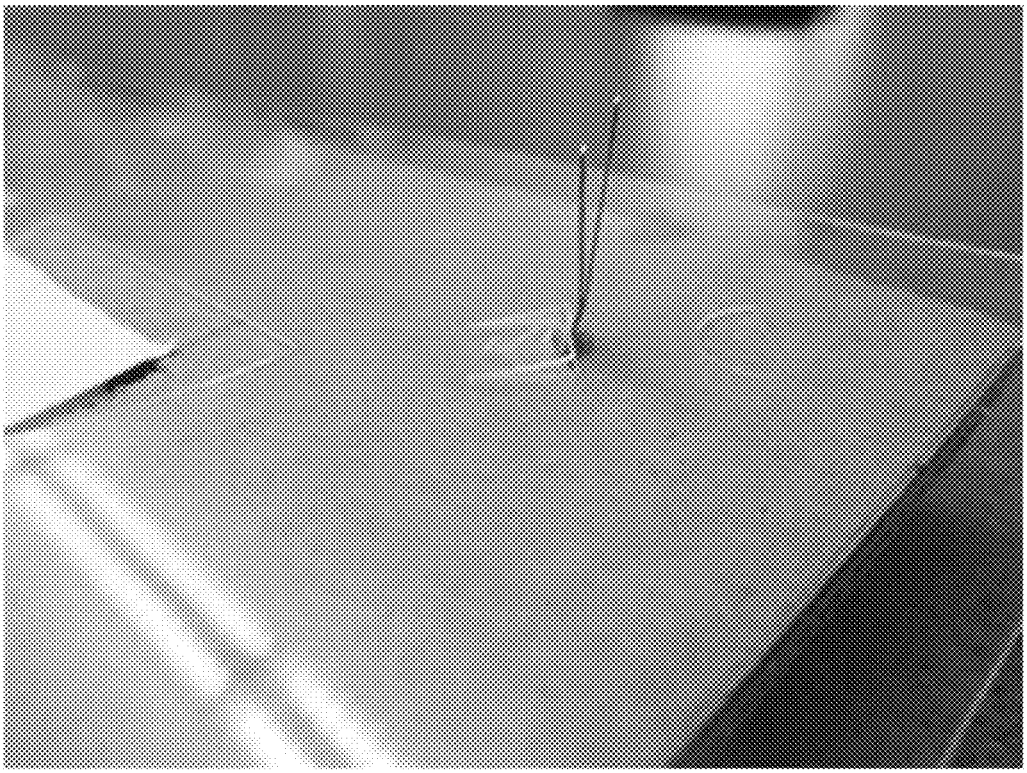
Figure 16:
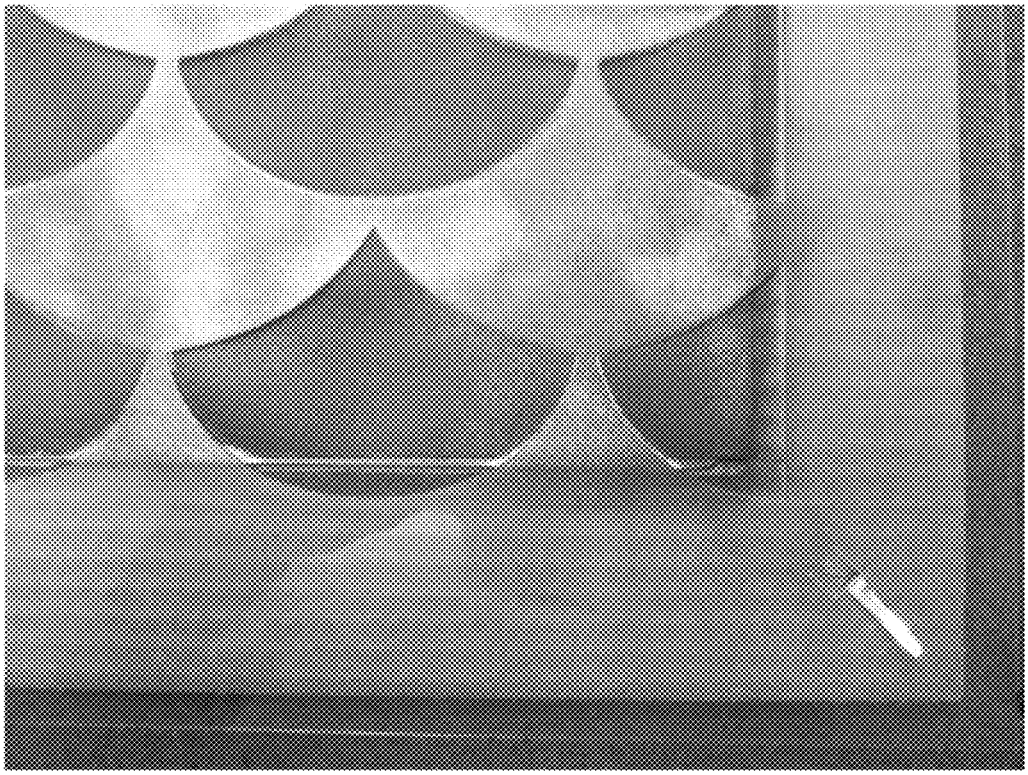
Figure 17:
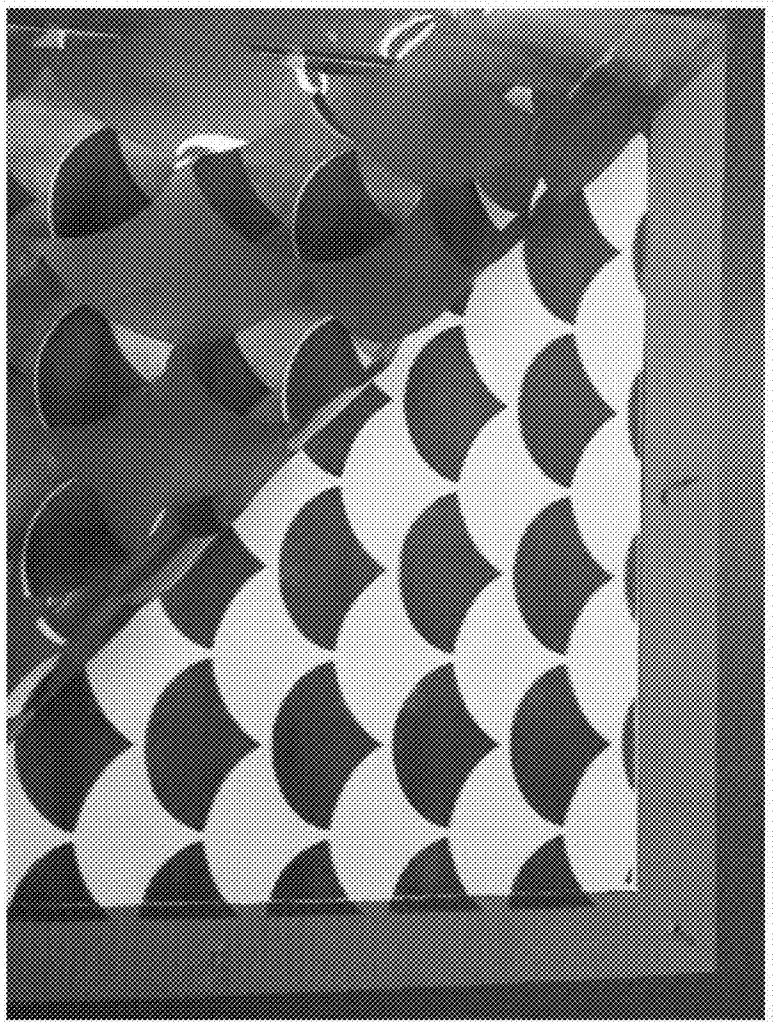
Figure 18:
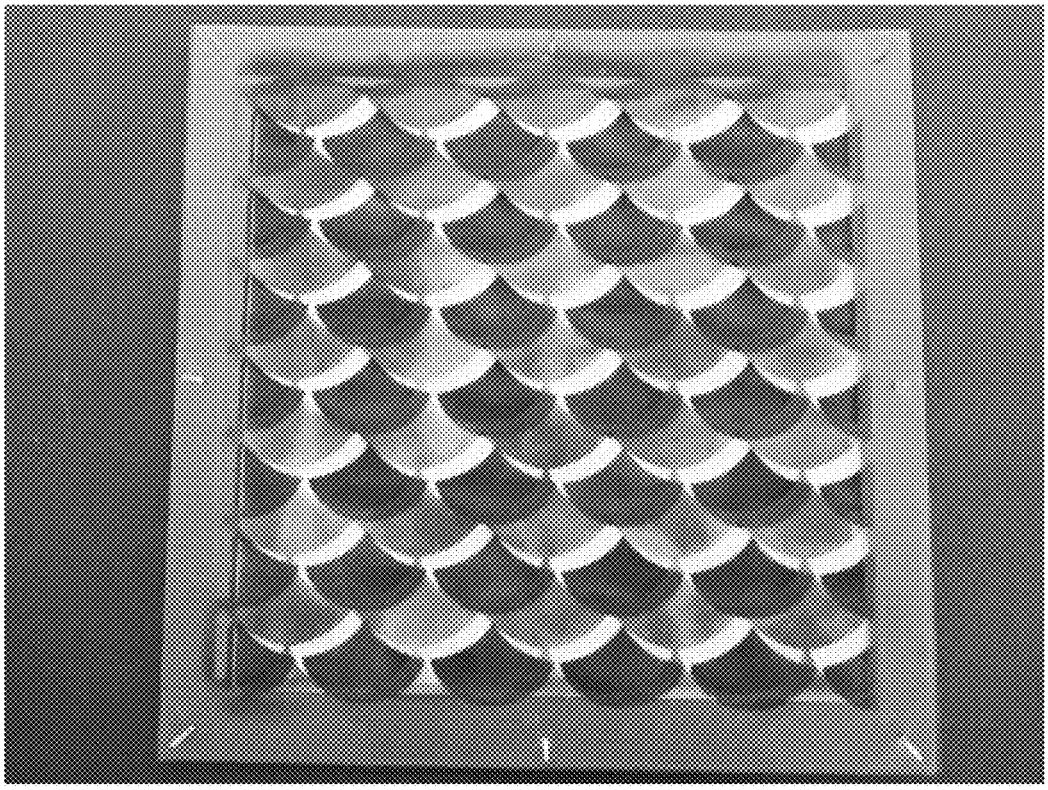
Figure 19:
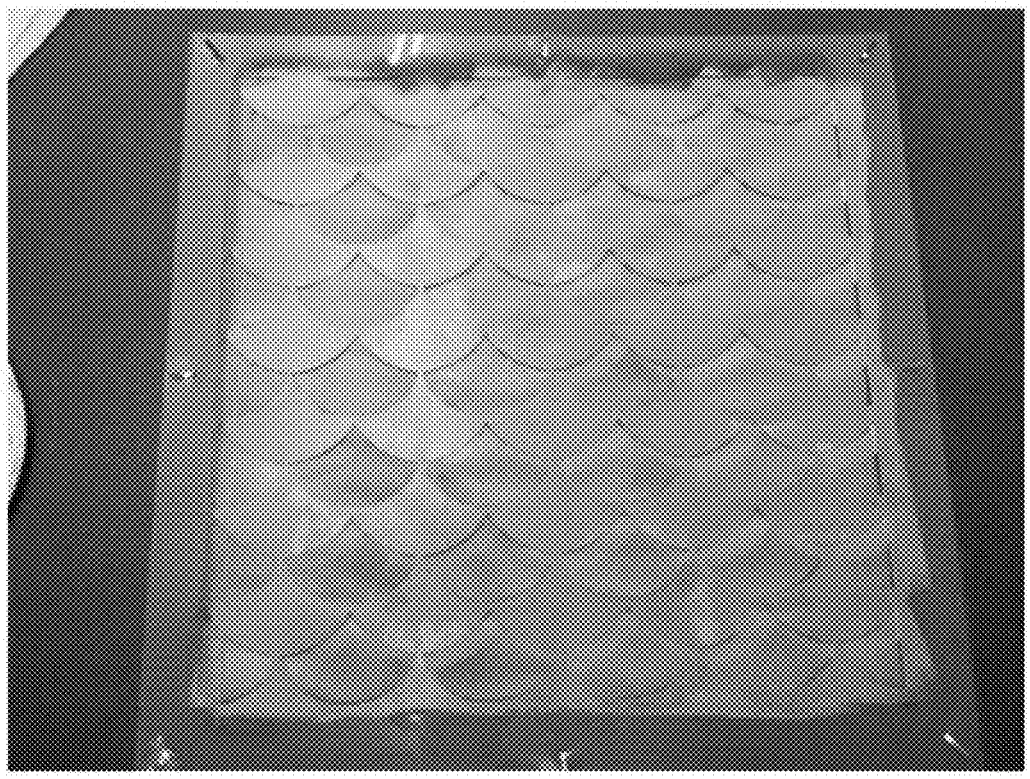
Figure 20:
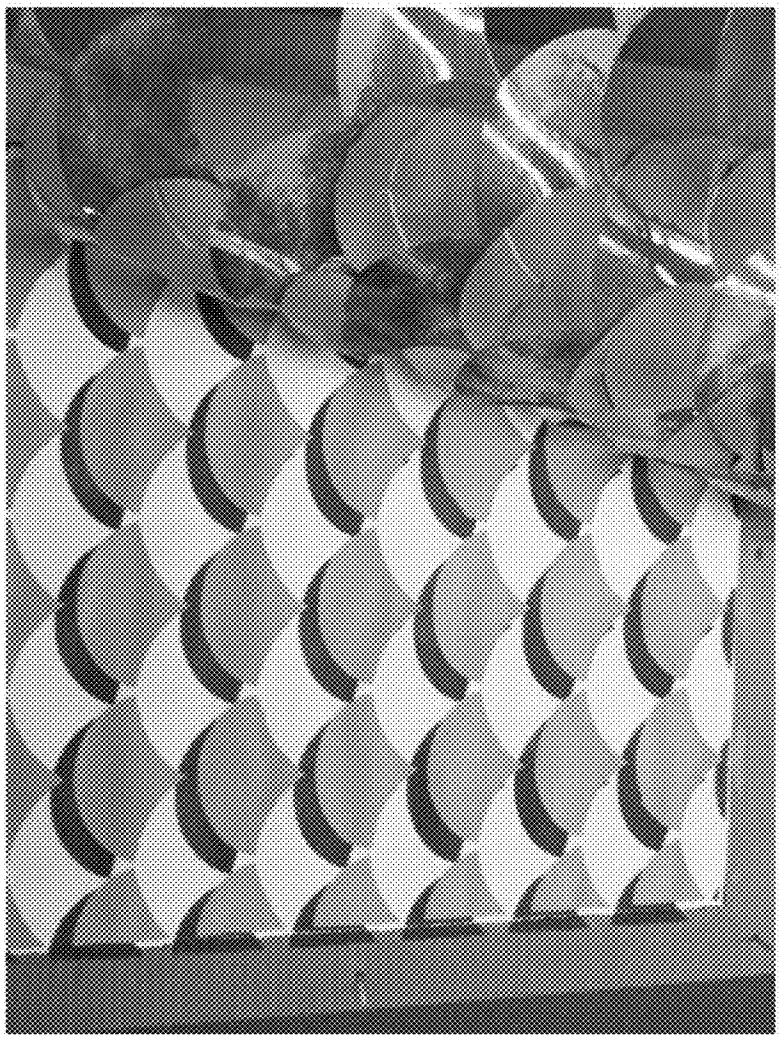
Figure 21:
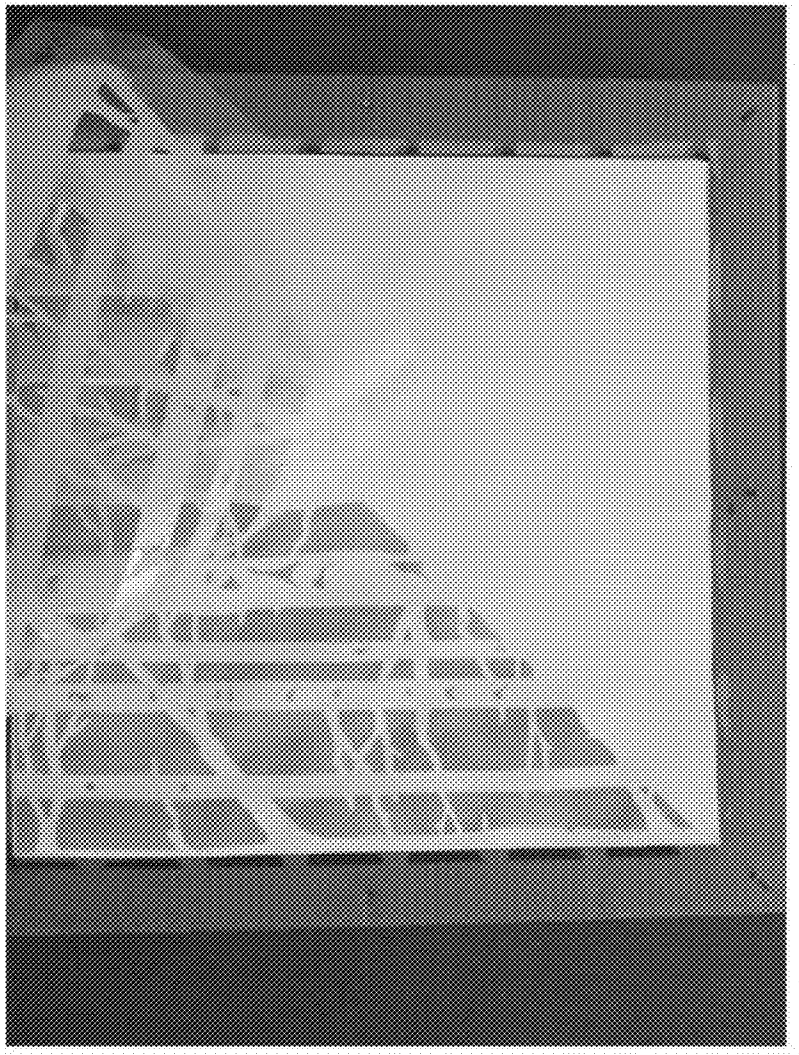
Figure 22:
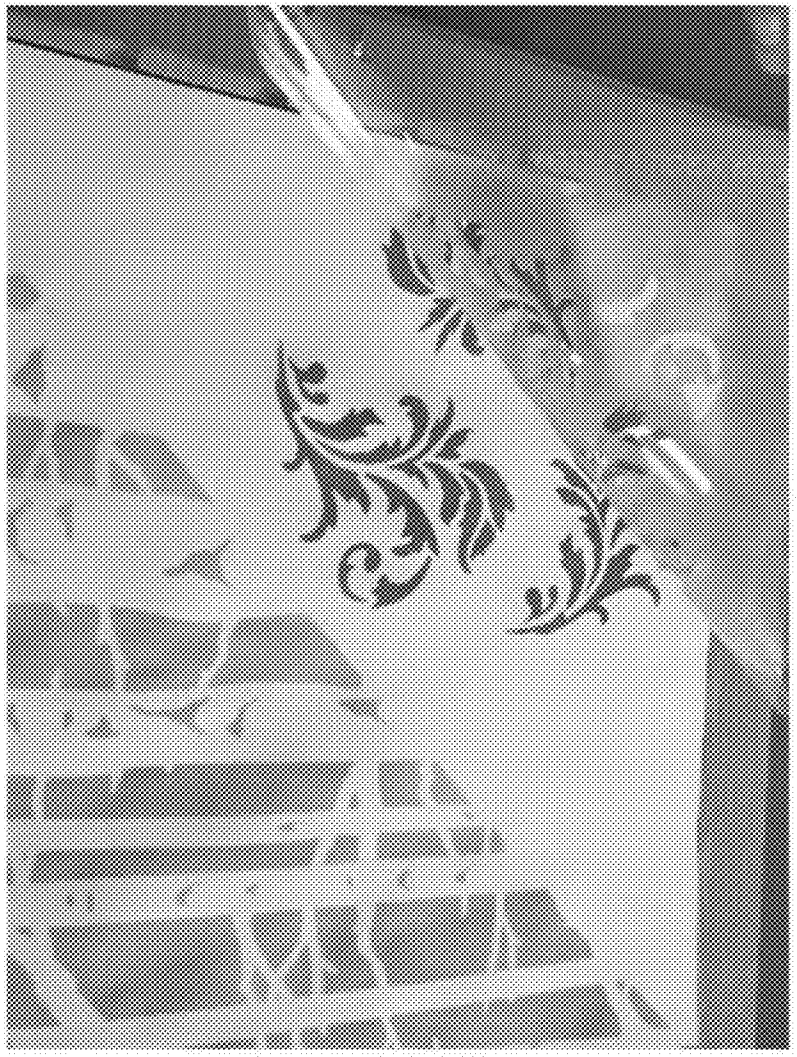
Figure 23:
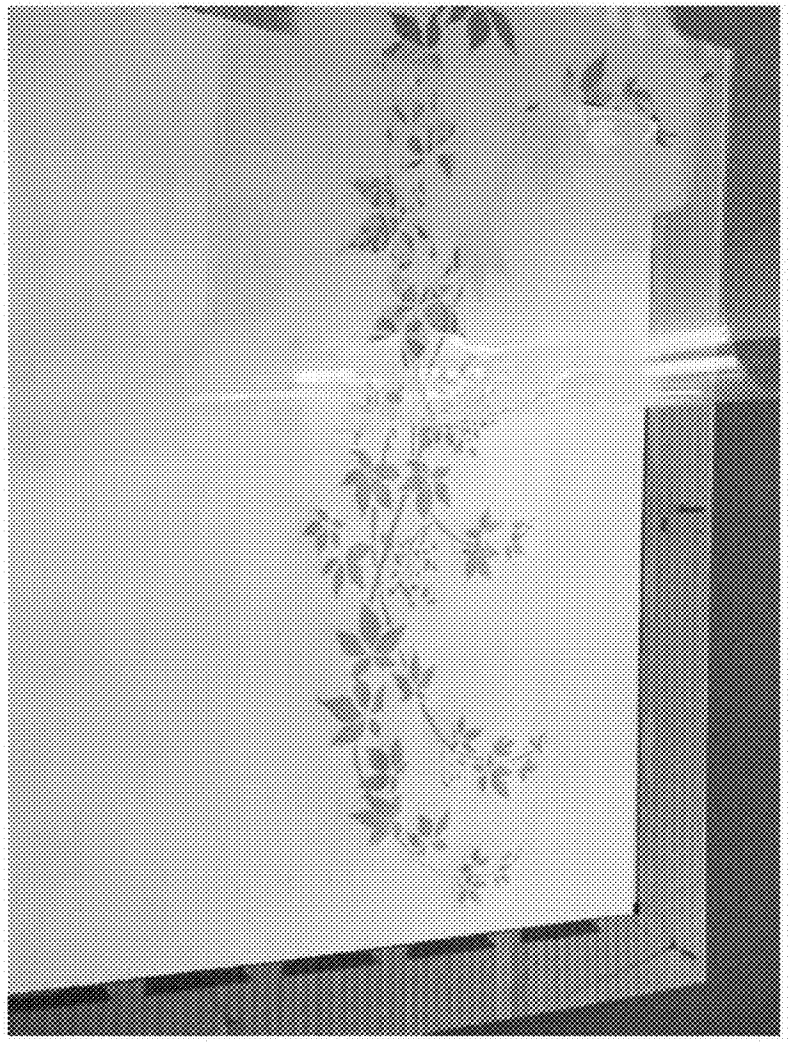
Figure 24:
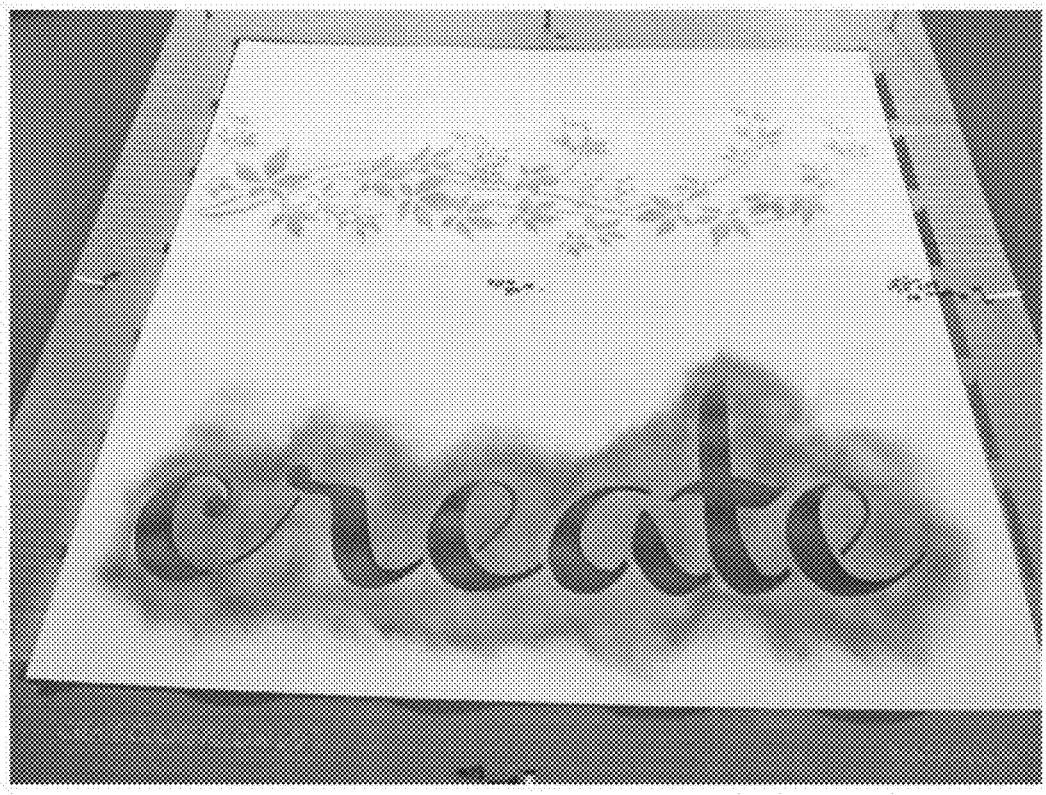
Figure 25:
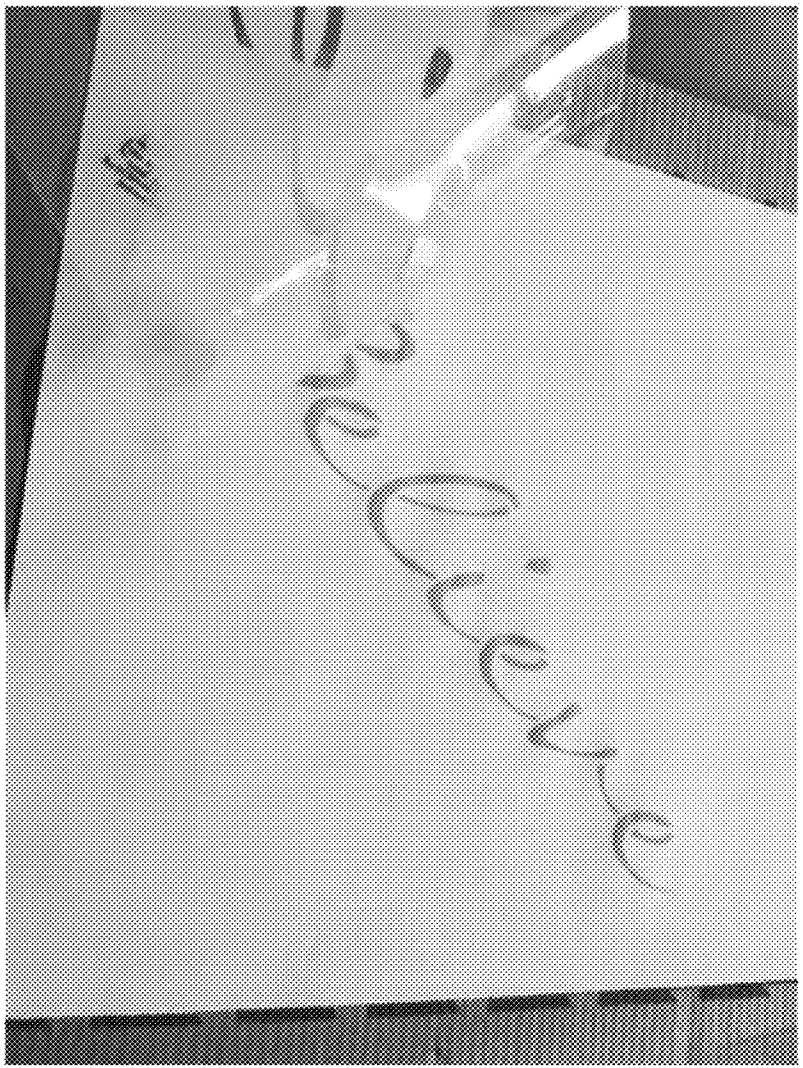
Figure 26:
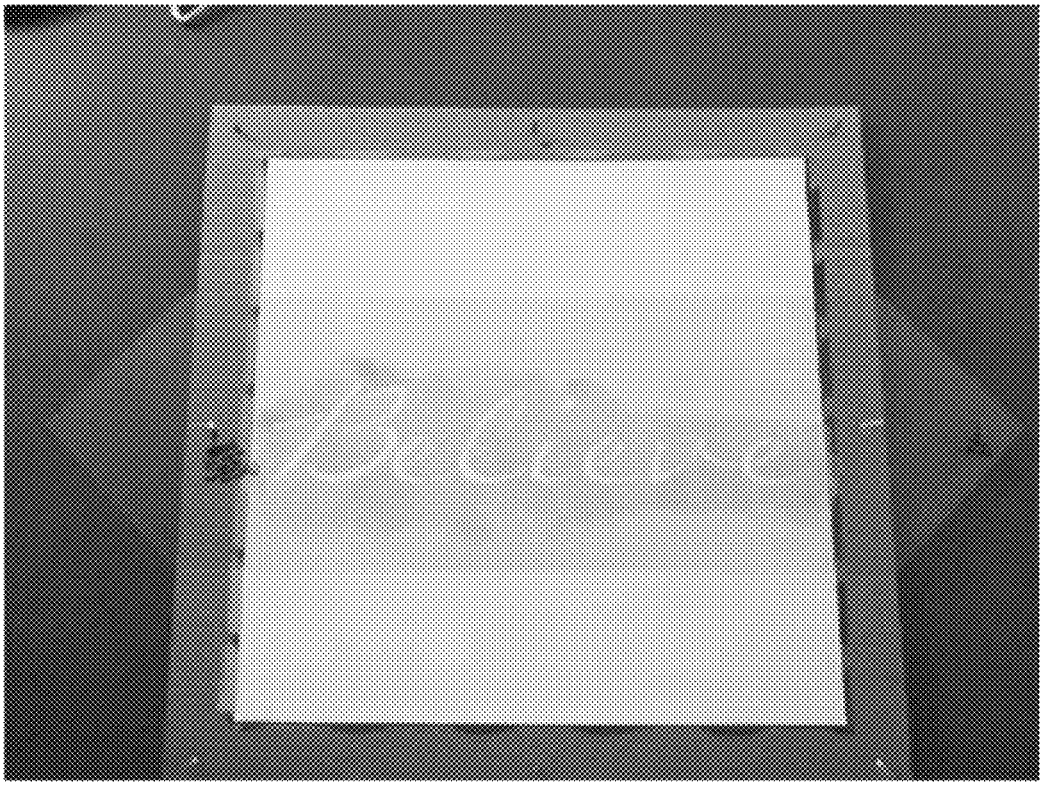
Figure 27:
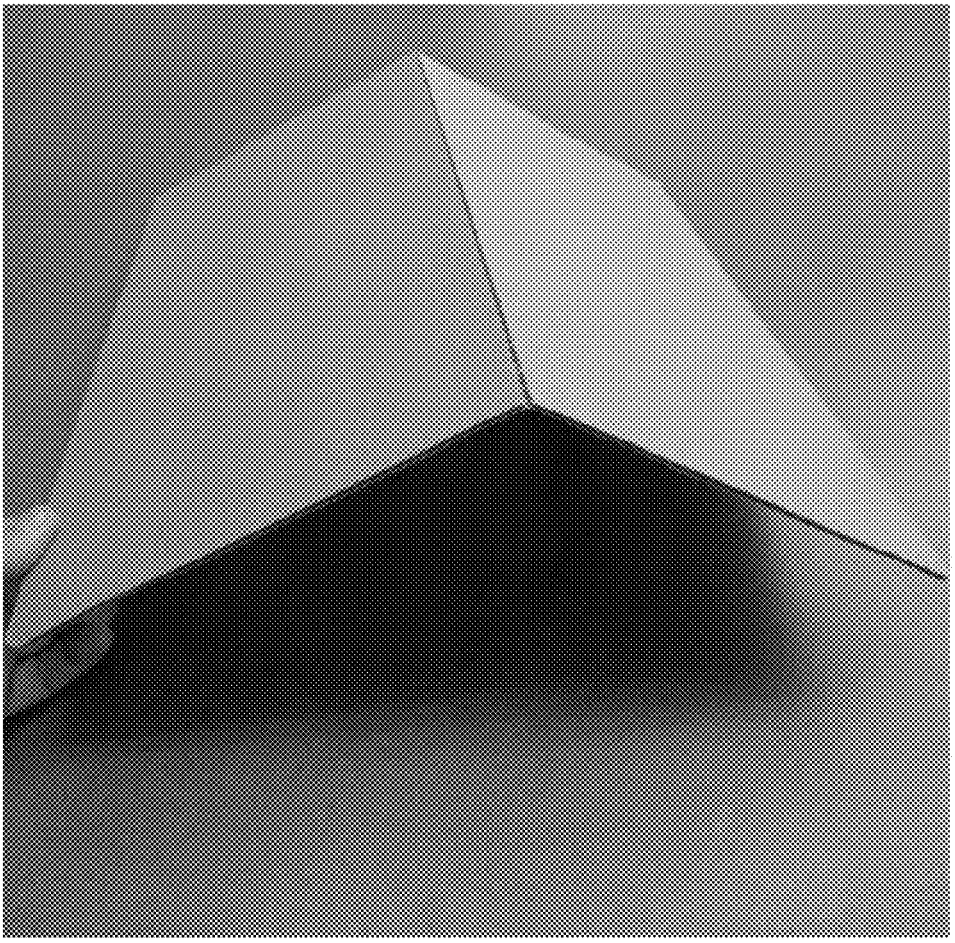
Figure 28:
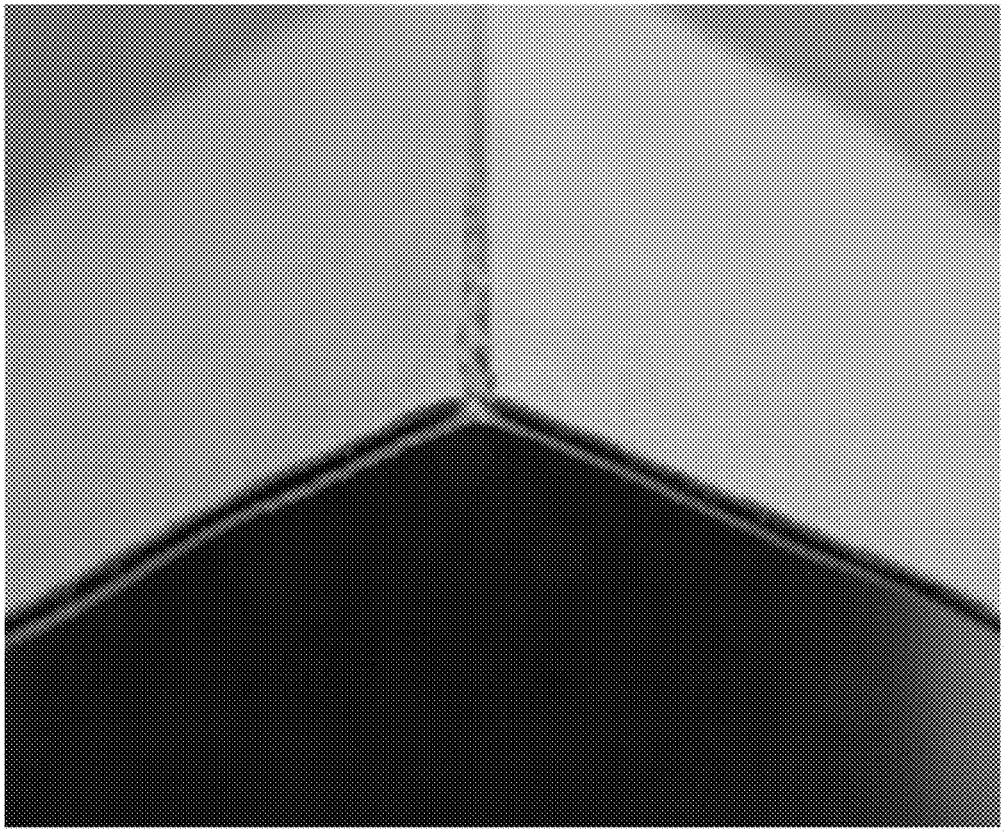
Figure 29:
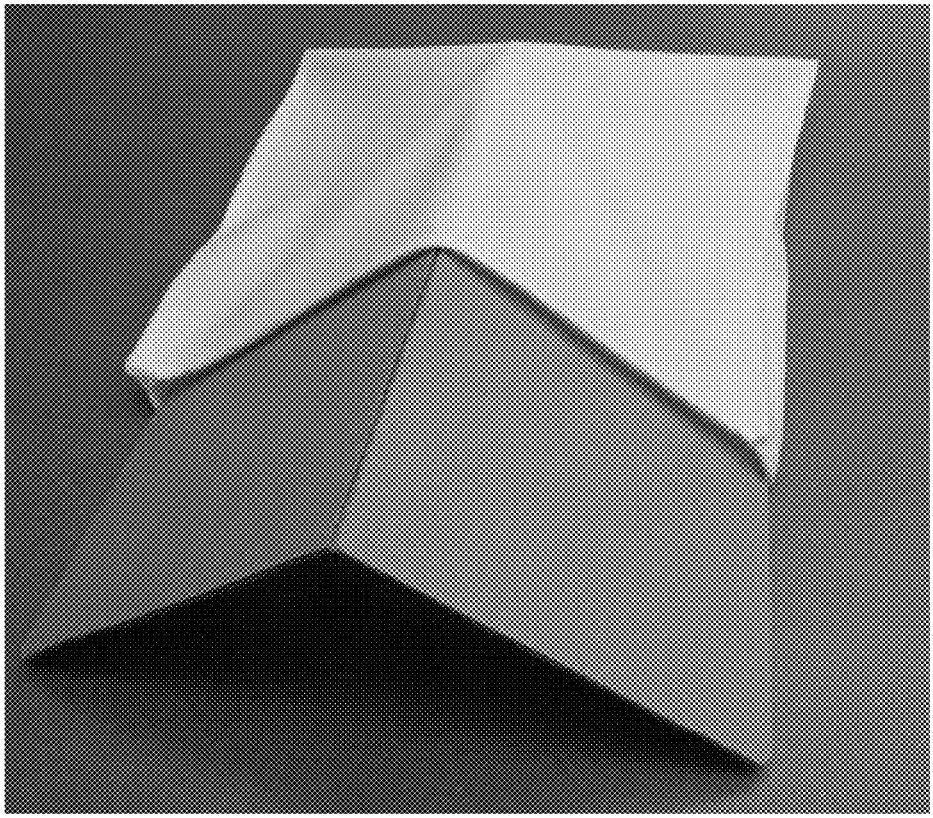
Figure 30:
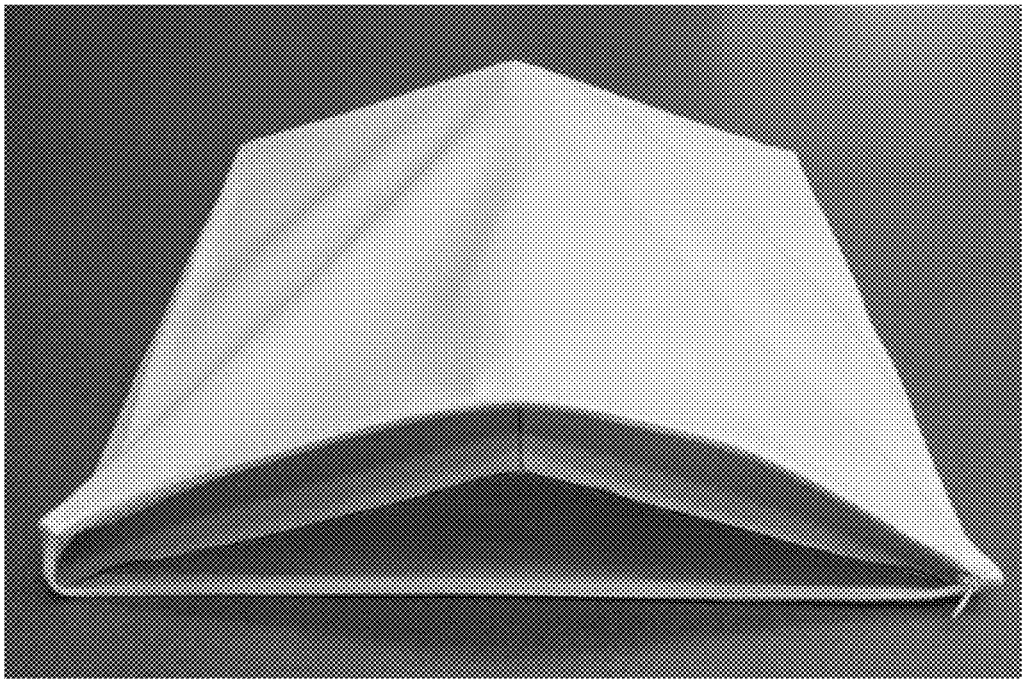
Figure 31:
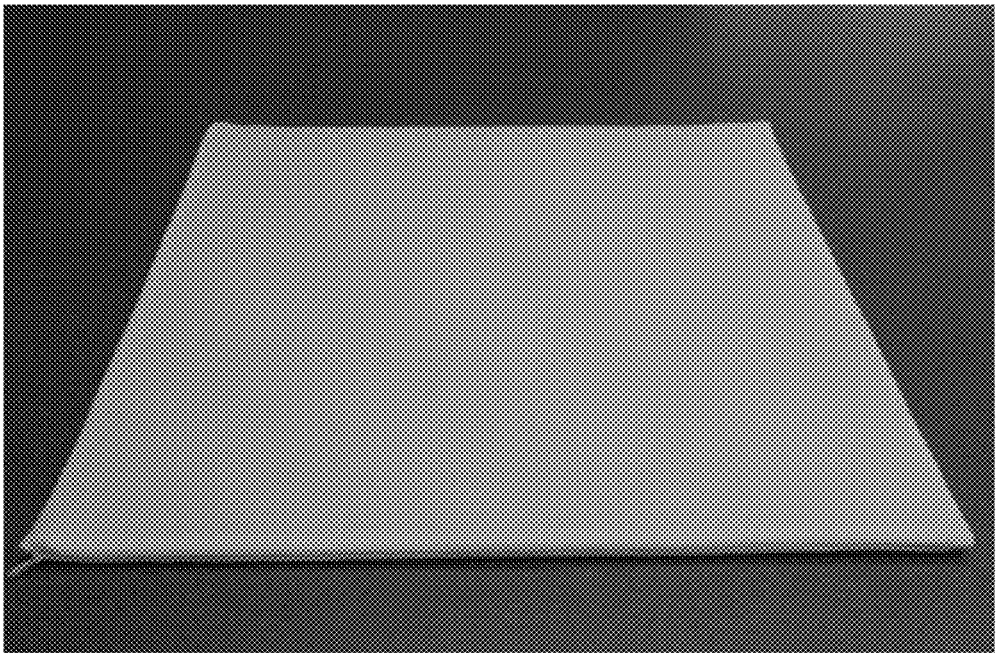
Figure 32:
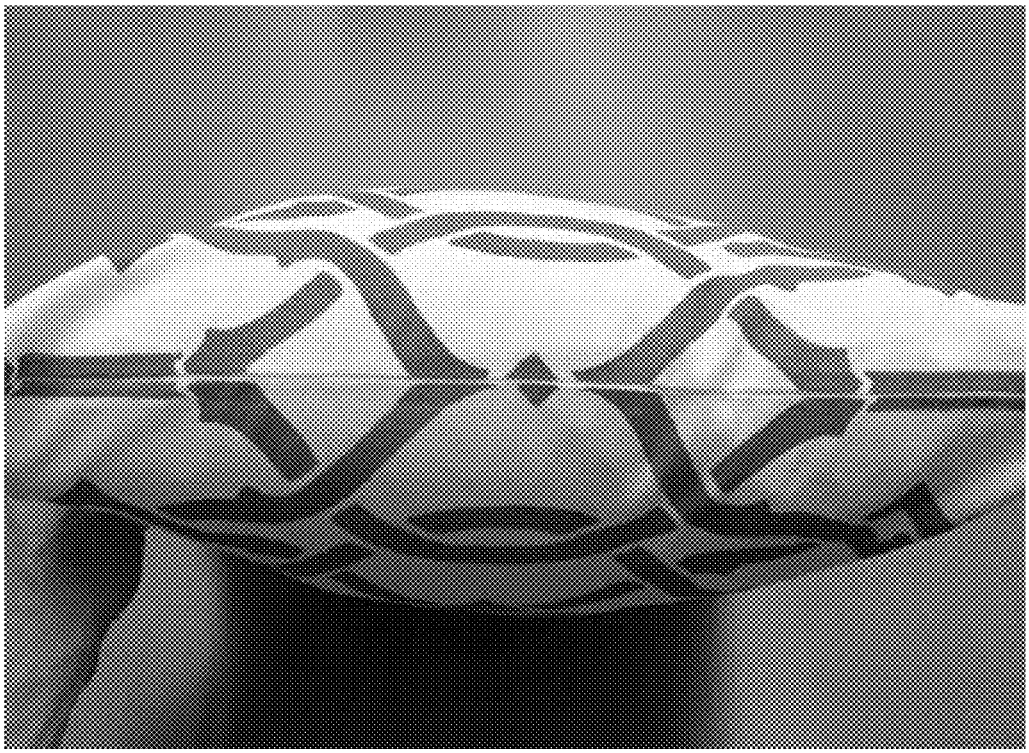

In one embodiment, a stencil that has slits/holes designed into it that align with fasteners, gets put on the frame. While the view of FIG. 5 may not be perfectly aligned, the present invention contemplates perfect to near perfect alignment.

In one embodiment, fasteners get bent outwards in opposite pairs, which creates a slight tension and secures the stencil in place.

In one embodiment, the device is now ready to paint.

In one embodiment, in one embodiment, the fabric paint is applied with a dense foam roller. In other embodiments, the paint can be applied using fabric spray paint, fabric markers, glitter, etc. A stencil brush and spraying bleach (to lighten the fabric) can be used and provided as well.

In one embodiment, once painting has been completed, the fasteners are bent in a manner to allow for the removal of the stencil.

The finished project is cured for a sufficient amount of time (depending on paint manufacturer it can be around 4-24 hours). In one embodiment, the finished project can be left in place while curing, or removed from the frame. Modern fabric paints do not require heat-setting with iron. Regular acrylics must be heat-set with iron on a low setting to prevent washing off. In certain embodiments, the cardboard insert inside the pillowcase can stay for that step, making ironing easier. In certain embodiments, before heat-setting, the painted fabric can be covered with a piece of cloth, so that the heat-setting is not applied directly to the painted surface.

When the paint is dry, the insert gets removed. In certain embodiments, the insert can be made of flexible cardboard. However, in one embodiment, the insert is styrene board. In other embodiments, the insert can be made of cardboard, such as corrugated cardboard. For example, the corrugated cardboard insert can include a half-slit to create a hinged cardboard insert that can fold so as to make it easier to place and remove the insert from the inside of a pillowcase or cushion covering.

In one embodiment, the pillowcase can then be stuffed with the filler pillow.

In one embodiment, the stenciled pillowcase having the pillow inserted is now complete and ready for use.

Variable Stenciling Patterns Using a Device of the Present Invention

In one embodiment, the device of the present invention can be used to make variable stenciling patterns, such as, but not limited to, drop shadow patterns.

While paper was used for demonstration purposes in certain embodiments, a fabric or fabric-like material (included but not limited to a pillowcase), can be used instead of paper. As shown in the figures, in one embodiment, the device of the present invention can be used with stencils that are made to include a "Drop Shadow" feature. For example, in one embodiment, the stencil includes a second set of holes (e.g., border cut-out regions of the stencil) that "jog" the stencil approximately ⅜" up or down and left or right depending on how the jig and stencil are oriented. This second set of holes is self-closing with a flap so that extra attention is necessary to position the stencil in Drop Shadow mode to eliminate the possibility of accidentally positioning the stencil in the wrong place.

Various Orientations of Stenciled Patterns Using a Device of the Present Invention As noted herein, the device, method, and kit can be used to make stencil patterns in various types of orientations. The device of the present invention can include a jig (also referred to as a frame) that also allows the user to stencil a variety of sizes and shapes. In certain embodiments, variations will allow the user to create their own unique pillow by mixing and matching full stencils, half stencils, corner stencils, vertical stencils, horizontal stencils, diagonal stencils and even circular stencils. The user can make a collage and can overlap the stencils for a layered look.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed is:

1. A device for applying a stencil pattern to a surface, said device comprising:

a frame for positioning a fabric or fabric-like material at a desired position, wherein said frame is in a geometric shape of a rectangle;

a baseboard attached to the frame for holding the fabric or fabric-like material at a desired depth below frame;

a frame insert comprising a planar surface having dimensions that fit inside the frame, wherein the frame insert is made of cardboard and is in a geometric shape of a rectangle, wherein said frame insert includes a half-slit to create a hinged cardboard insert that can fold in half, and wherein said frame insert is used for maintaining the surface of the fabric or fabric-like material in a substantially flattened position within the frame and under the stencil; and at least one set of fasteners integrated at opposing positions on the frame, wherein the at least one set of fasteners is positioned at opposing corners of the rectangle shaped frame and on opposing sides of the rectangle shaped frame, wherein the fasteners are used for positioning and securing a stencil at a desired position over the fabric or fabric-like material.

2. The device according to claim 1, wherein the at least one set of fasteners is positioned on the frame to enable securing the stencil so that the stencil pattern can be applied to the desired surface in a vertical, horizontal, and/or diagonal orientation in reference to the surface to be stenciled.

3. The device according to claim 1, wherein the fabric or fabric-like material is selected from the group consisting of a pillowcase, a tote bag, a shirt, a flag, a banner, a jacket, a garment, a bag, a backpack, a tent, a cap, a scarf, a bandana, and the like.

4. A kit for applying a stencil pattern or multiple stencil patterns to a surface, the kit comprising:

a device according to claim 1 for applying a stencil pattern to a surface of a fabric or fabric-like material; and at least one stencil configured for use with the device.

5. The kit according to claim 4, wherein the at least one stencil comprises a border region configured to fit over the frame of the device.

6. The kit according to claim 5, wherein the border region of the at least one stencil includes cut-out regions for interfacing with the frame fasteners of the frame.

7. The kit according to claim 6, wherein the cut-out regions are configured for fixed positioning or variable positioning of the stencil in reference to a particular pair of frame fasteners.

8. The kit according to claim 7, wherein the variable positioning of the cut-out regions of the stencil are effective to produce a shadow effect of the stencil pattern on the fabric or fabric-like material.

9. The kit according to claim 4, wherein the fabric or fabric-like material is selected from the group consisting of a pillowcase, a tote bag, a shirt, a flag, a banner, a jacket, a garment, a bag, a backpack, a tent, a cap, a scarf, a bandana, and the like.

10. A method for applying a stencil pattern to a surface, said method comprising the steps of:

providing a device according to claim 1 for applying a stencil pattern to a surface of a fabric or fabric-like material;

using the device to secure a stencil over the fabric or fabric-like material at a desired position, wherein the stencil comprises a pattern to be transferred to the fabric or fabric-like material; and painting over the stencil in order to apply the stencil pattern to the fabric or fabric-like material.

11. A device for applying a stencil pattern to a surface, said device comprising:

a frame for positioning a fabric or fabric-like material at a desired position, wherein said frame is in a geometric shape of a square;

a baseboard attached to the frame for holding the fabric or fabric-like material at a desired depth below frame;

a frame insert comprising a planar surface having dimensions that fit inside the frame, wherein the frame insert is made of cardboard and is in a geometric shape of a square, wherein said frame insert includes a half-slit to create a hinged cardboard insert that can fold in half, and wherein said frame insert is used for maintaining the surface of the fabric or fabric-like material in a substantially flattened position within the frame and under the stencil; and at least one set of fasteners integrated at opposing positions on the frame, wherein the at least one set of fasteners is positioned at opposing corners of the square shaped frame and on opposing sides of the square shaped frame, wherein the fasteners are used for positioning and securing a stencil at a desired position over the fabric or fabric-like material.

12. The device according to claim 11, wherein the fabric or fabric-like material is selected from the group consisting of a pillowcase, a tote bag, a shirt, a flag, a banner, a jacket, a garment, a bag, a backpack, a tent, a cap, a scarf, a bandana, and the like.

13. A method for applying a stencil pattern to a surface, said method comprising the steps of:

providing a device according to claim 11 for applying a stencil pattern to a surface of a fabric or fabric-like material;

using the device to secure a stencil over the fabric or fabric-like material at a desired position, wherein the stencil comprises a pattern to be transferred to the fabric or fabric-like material; and painting over the stencil in order to apply the stencil pattern to the fabric or fabric-like material.

14. A kit for applying a stencil pattern or multiple stencil patterns to a surface, the kit comprising:

a device according to claim 11 for applying a stencil pattern to a surface of a fabric or fabric-like material; and at least one stencil configured for use with the device.

15. The kit according to claim 14, wherein the at least one stencil comprises a border region configured to fit over the frame of the device.

16. The kit according to claim 15, wherein the border region of the at least one stencil includes cut-out regions for interfacing with the frame fasteners of the frame.

17. The kit according to claim 16, wherein the cut-out regions are configured for fixed positioning or variable positioning of the stencil in reference to a particular pair of frame fasteners.

18. The kit according to claim 17, wherein the variable positioning of the cut-out regions of the stencil are effective to produce a shadow effect of the stencil pattern on the fabric or fabric-like material.

19. The kit according to claim 14, wherein the fabric or fabric-like material is selected from the group consisting of a pillowcase, a tote bag, a shirt, a flag, a banner, a jacket, a garment, a bag, a backpack, a tent, a cap, a scarf, a bandana, and the like.

* * * * *